United States Patent [19]

McDonald

[11] 4,363,392

[45] Dec. 14, 1982

[54] PRODUCT DISPENSER HAVING INCREASED COIN HOLDING CAPACITY

[76] Inventor: Winford G. McDonald, 128 Hill, Center, Tex. 75935

[21] Appl. No.: 210,224

[22] Filed: Nov. 25, 1980

[51] Int. Cl.[3] ..... G07F 9/06

[52] U.S. Cl. ..... 194/1 B; 221/281; 232/15

[58] Field of Search ..... 194/1 A, 1 B, 2; 221/281; 232/15, 16

[56] References Cited

U.S. PATENT DOCUMENTS

| | | | |
|---|---|---|---|
| 1,186,031 | 6/1916 | Patterson et al. | 221/281 X |
| 3,494,454 | 2/1970 | Calgaro et al. | 194/1 B |
| 3,833,104 | 9/1974 | Blum | 194/1 B |
| 3,926,366 | 12/1975 | Sciortino | 232/15 |

FOREIGN PATENT DOCUMENTS

| | | | |
|---|---|---|---|
| 2538025 | 3/1977 | Fed. Rep. of Germany | 194/1 B |

*Primary Examiner*—F. J. Bartuska
*Attorney, Agent, or Firm*—D. Paul Weaver

[57] ABSTRACT

To increase the coin holding capacity of a product dispenser in order to compensate for an increased price of the product, and to avoid restructuring the wall-attached support plate for the dispenser, the dispenser coin box, adjacent product outlet portion of the dispenser and the coin box guard structure, are extended downwardly and forwardly from the lower end of the wall-attached support plate thus forming an inclined bottom on the dispenser and enabling the customary mounting procedure for the dispenser on the support plate.

4 Claims, 11 Drawing Figures

FIG.1
PRIOR ART
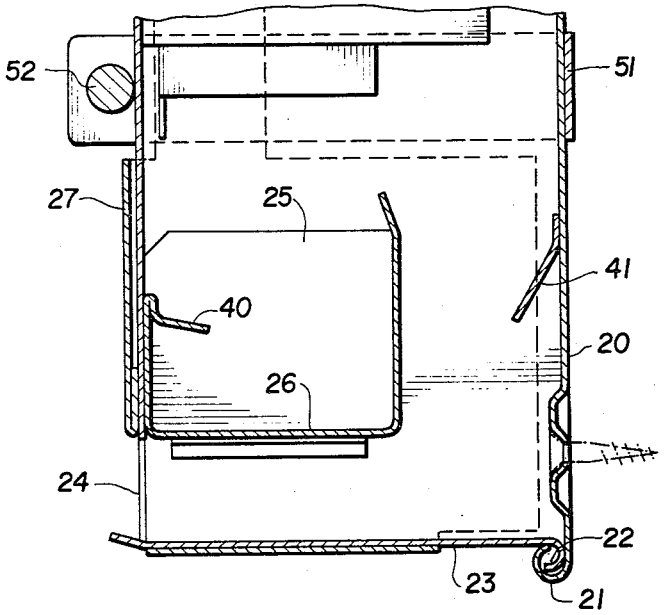
FIG.3
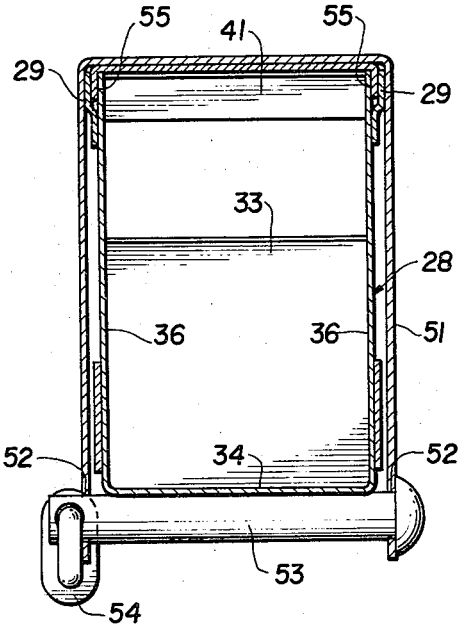
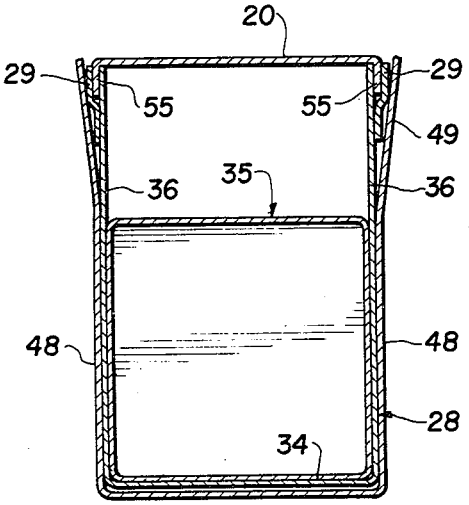
FIG.4

FIG.10
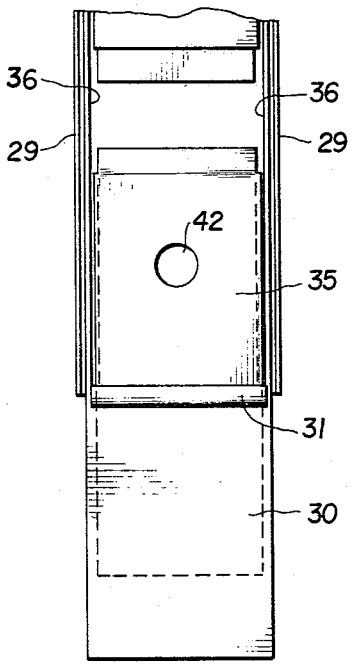
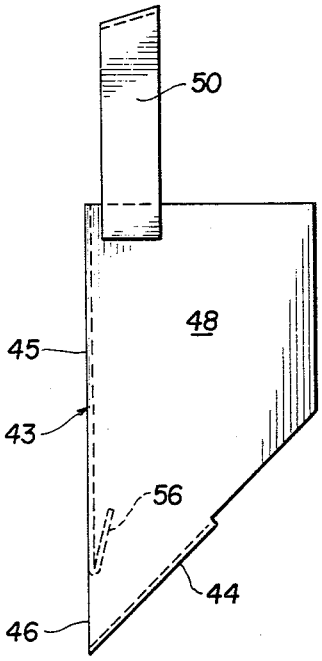
FIG.5
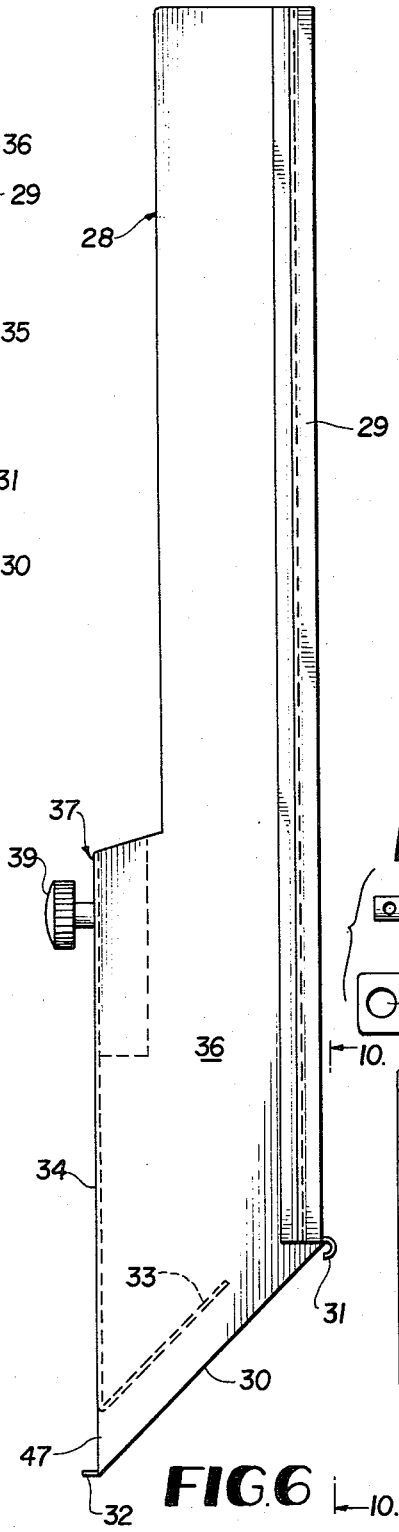
FIG.6
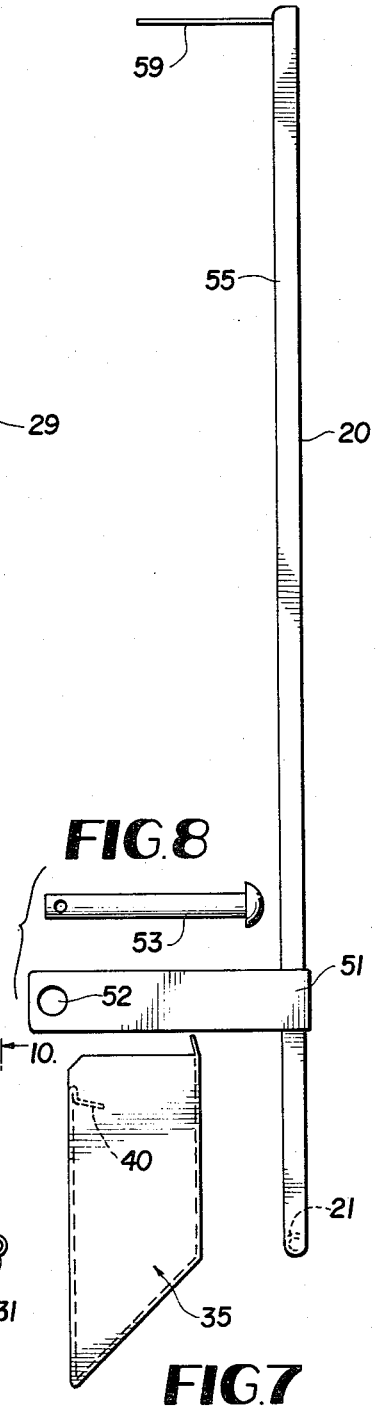
FIG.8
FIG.7

PRODUCT DISPENSER HAVING INCREASED COIN HOLDING CAPACITY

BACKGROUND OF THE INVENTION

A certain widely-used product dispenser is releasably locked to and supported by a wall-attached plate having a certain standard length. The traditional dispenser has a coin mechanism which accepts quarters. The product storage cabinet portion of the dispenser was originally designed to hold a certain number of product units at a then prevailing price per unit, such as two quarters. The coin receptacle at the bottom of the dispenser was designed to hold the number of quarters required to completely exhaust the product supply in the dispenser. The dispenser has been traditionally manufactured in single or multiple storage column forms and the principle or concept applies to either case.

Traveling operators of these dispensers sometimes have routes spanning 1000 miles or more, and periodically they resupply the dispensers along the route with the product and collect the coins which have accumulated in the coin box at each location.

In recent years, the dispensed product like all other commodities have increased in cost and the product unit selling price has become three quarters and in some cases four quarters. This has created a serious problem for the machine operators because, if they completely fill the dispenser with the product, the capacity of the coin box is exceeded. As a consequence, the operators are forced to only partly fill the dispenser with the product and the dispenser will be empty for a long time before the operator can again resupply it on his rounds. This causes an obvious economic hardship, and it is the main object of this invention to deal successfully and economically with the above-stated problem.

In the traditional dispenser structure, the bottom wall of the dispenser is level during normal usage and projects forwardly of the wall-attached dispenser support plate at the bottom thereof and at right angles thereto. Interfitting elements on the dispenser bottom wall and the lower end of the support plate allow unlocking the top of the dispenser and pivoting it forwardly and away from the wall-attached plate to refill the dispenser, followed by returning the dispenser by a swinging movement to a vertical position against the wall-attached support plate and locking it to this plate at the top of the dispenser with a key.

A main objective of the invention is to preserve this simple and convenient mode of operation while greatly increasing the coin holding capacity of the dispenser and while avoiding any lengthening or restructuring of the standard length wall-attached support plate.

This objective is accomplished in the invention by extending the bottom of the dispenser body, the coin box therein and the armored guard around the lower portion of the dispenser downwardly and forwardly from the lower end of the support plate preferably at an angle of about 45 degrees to the adjacent wall. This tapared configuration of the bottom of the dispenser achieves the necessary increase in coin holding capacity, improves the actual gravity-assisted product dispensing mode, and enables the use of the same standard wall-attached dispenser support plate and the same convenient mode of attachment of the dispenser to the support plate as well as the convenient swinging mode of operation to and from the vertical lock and forwardly inclined servicing positions of the dispenser.

Other features and advantages of the invention will appear to those skilled in the art during the course of the following description. It should be noted that the invention is applicable equally to single column or multi-column dispensers, a single column dispenser being shown in the drawings for ease of illustration. It should also be mentioned that the invention can be embodied in newly-manufactured machines or can be added to existing machines in the field in the form of a retrofit kit.

BRIEF DESCRIPTION OF THE DRAWINGS

FIG. 1 is a fragmentary vertical section through the lower portion of a dispenser as constructed in the prior art.

FIG. 3 is a horizontal section taken on line 3—3 of FIG. 2.

FIG. 4 is a similar section taken on line 4—4 of FIG. 2.

FIG. 5 is a side elevation showing a guard.

FIG. 6 is a similar view showing the body portion of the dispenser in accordance with the invention.

FIG. 7 is a similar view showing a coin box.

FIG. 8 is a side elevational view showing a wall-attached dispenser support plate and associated elements.

FIG. 10 is a partial rear elevation taken on line 10—10 of FIG. 6.

DETAILED DESCRIPTION

Figure 1A:
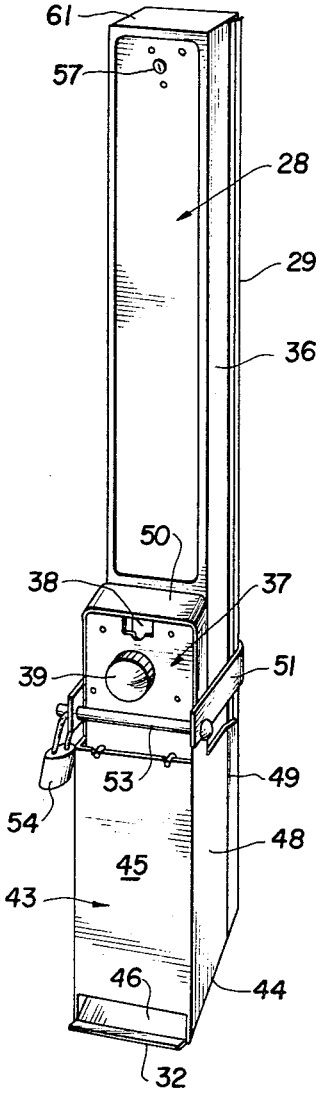
FIG. 1A is a perspective view of the dispenser constructed in accordance with the invention.

Referring to the drawings in detail wherein like numerals designate like parts, and referring first to FIG. 1, the lower end portion of a dispenser constructed in accordance with the prior art is illustrated. A wall-attached metal mounting plate 20 is shown having a curl or knuckle 21 formed on its lower end to interfit pivotally with a coacting knuckle 22 on the bottom wall 23 of the prior art dispenser body, such bottom wall extending forwardly from the mounting or support plate 20 in right angular relationship thereto. The product being dispensed, not shown, in the form of a thin wafer-like packet is released from an overhead storage column, not shown, by operation of a conventional coin mechanism, not shown. The released product unit gravitates onto the bottom wall 23 at a point near the rear of the dispenser and the dispensed product unit can be reached by the customer through a frontal outlet slot 24. At the time of dispensing, the coins, such as two or more quarters, fall into a generally rectangular coin box 25 having a level bottom wall 26 spaced above the wall 23 and parallel thereto. The prior art dispenser further includes a lockable guard 27 whose purpose and construction will be amplified in the description of the invention or improvement. FIG. 1 illustrates the limited capacity of the coin box 25 and further illustrates how lengthening the coin box in the downward direction and correspondingly lowering the level bottom wall 23 of the dispenser would necessitate redesigning the support plate 20 or lengthening it.

Referring to the other drawing figures showing the invention, a dispenser for a thin wafer-like product packet, not shown, comprises an elongated vertical rectangular cross section body portion 28 constructed generally in accordance with the prior art and having conventional internal means for holding the product units in stacked relationship in a vertical column or columns prior to dispensing. The rear side of the body portion 28 is open while its opposite sides, top and front are closed, as illustrated. A pair of comparatively heavy strips 29 welded to the side walls of the body portion 28 extend continuously from the top thereof to the lower end of the rear vertical side of the body portion, FIG. 6.

The prior art wall-attached metal support plate 20 shown in FIG. 1 is utilized in the present invention without change including the lower end knuckle 21. This plate can remain permanently fixed upon a wall and need not be disturbed when the dispenser is to be restocked or otherwise serviced or replaced by another dispenser constructed in accordance with the invention or in accordance with the prior art.

In attaining the main objective of increased coin storage capacity, the bottom wall 30 of the dispenser body portion 28 is extended downwardly and forwardly from the lower end of the plate 20 preferably at an angle of 45 degrees thereto and to the adjacent wall. The upper end of the wall 30 carries a knuckle 31 corresponding in purpose to the prior art knuckle 22 and interfitting rotationally with the knuckle 21 of support plate 20. The lower end of inclined wall 30 may carry a short leading horizontal lip 32 for convenience. An inclined panel 33 is provided within the body portion 28 above and parallel to the bottom wall 30 and this panel converges with the front vertical wall 34 of the body portion to form a downwardly tapering pocket for the location and support of a similarly tapering enlarged coin box 35, to be further described. The panel 33 may be integral with the front wall 34 and is suitably attached by welding to the two side walls 36 of body portion 28.

Conventionally fixed upon the front of body portion 28 and forming a permanent part thereof is a commercial coin mechanism 37 whose details are known and are not a part of this invention. This mechanism has a frontal slot 38 to receive coins, such as quarters, and includes a spring-loaded turning knob 39 to deliver each coin into the mechanism and to simultaneously release one product unit from the bottom of the stack which then falls by gravity behind the coin box 35 and onto the inclined bottom wall 30, as shown by the directional arrows in FIG. 2. As compared to the level bottom wall 23 of the prior art, FIG. 1, the inclined wall 30 aids gravity in delivering the product forwardly to a customer and this is an improvement by-product of the invention.

Figure 2:
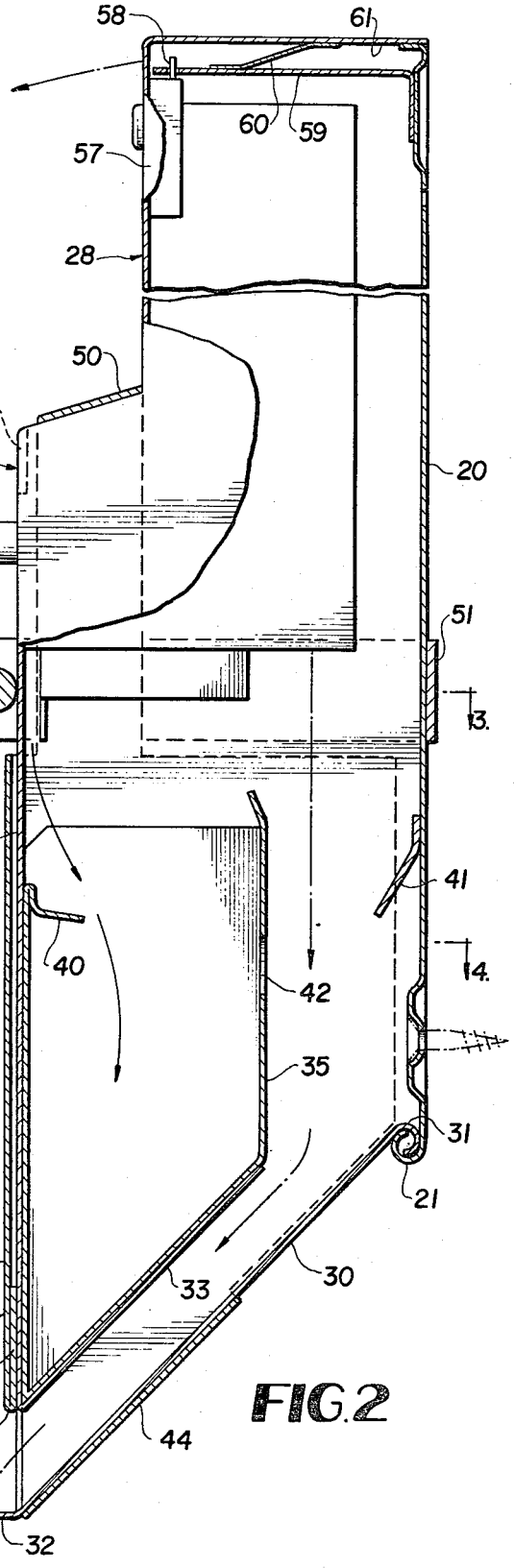
FIG. 2 is a vertical section taken centrally through the dispenser in FIG. 1A, partly broken away and on an enlarged scale.

The enlarged coin box or receptacle 35 has an open top, is rectangular in horizontal cross section, and preferably has an internal coin deflector 40 on its forward wall projecting rearwardly therefrom to assure that deposited coins fall centrally into the coin box as shown by the directional arrows in FIG. 2. A similar product deflector element 41 is carried by the wall-mounted support plate 20 and causes the falling product units to travel centrally in the passageway between the plate 20 and the back wall of the coin box so that there is no likelihood of the product becoming hung up in the passageway. The coin box 35 is provided in its back wall with a centrally located finger opening 42 to assist in lifting the coin box through the open rear side of the body portion 28 as when emptying the coins into a collection receptacle. The bottom portion of the coin box is tapered and wedge-like to fit snugly in the pocket provided by the front and side walls of body portion 28 and the panel 33.

The invention further comprises a strong metal security guard 43 for the lower portion of the dispenser adjacent to the enlarged coin box. This security guard has a foreshortened inclined bottom wall 44 to fit under the bottom wall 30 in contacting parallel relation thereto. It includes a vertical front wall 45 terminating above the lower end of wall 44 to form a product outlet 46 in registry with the outlet 47 of body portion 28 when the components are assembled, FIGS. 1A and 2. The guard includes opposite side walls 48 which extend to the rear of the assembly, FIG. 4, and are flared as at 49 to pass over the vertical strips 29. Except for the inclined wall 44, the rear side of the guard 43 is open. Its top is also open so that the guard essentially is a three-sided structure with a partial bottom wall, as described.

The guard also includes an inverted U-shaped loop 50 welded or otherwise attached to side walls 48 and rising therefrom vertically. This loop engages over the top of the coin mechanism 37 and extends downwardly along the opposite sides of the mechanism, FIG. 1A. When so applied to the dispenser, it is impossible to displace the guard 43 upwardly or downwardly. For further security, a U-shaped locking loop 51 having opposite side apertures 52 slightly ahead of the front wall 34 is provided. This locking loop extends horizontally around the back and two opposite sides of the assembly and receives across the front of the assembly a heavy removable locking pin 53 secured by a padlock 54. When so locked, it is impossible for an intruder to remove the guard 43 from the dispenser or get at the coin box 35.

Details which may be noted are that the wall-attached plate 20 has vertical side flanges 55 thereon which engage between the offset rear ends of strips 29, FIG. 4, and the side walls 36 of body portion 28. Preferably, but not necessarily, a spring-like flange 56 is provided on the interior of the front wall 45 of guard 43 and is compressed during assembly, FIG. 2, between the front wall of the guard and the corresponding wall 34 of body portion 28, see FIG. 2.

For locking the upper end of the dispenser to the fixed support plate 20, a conventional key lock 57 is provided on the front wall of body portion 28, such lock having a bolt 58 to engage a locking aperture in a horizontal locking tongue 59 secured to the plate 20 near its top. A stabilizing strut 60 for the tongue 59 carried by the top wall 61 of body portion 28 may be provided.

The described construction is simple, sturdy and is characterized by ease of assembly and convenience of use, as well as low cost of manufacturing.

Figure 9:
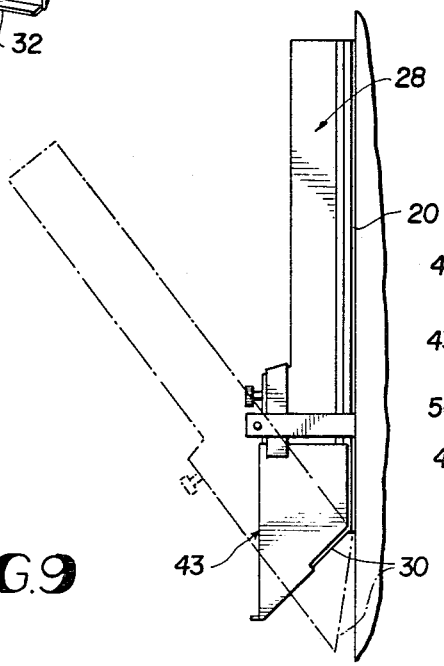
FIG. 9 is a diagrammatic side elevation, on a reduced scale, showing the operational mode for servicing the dispenser.

FIG. 9 illustrates how, after unlocking the top of the dispenser with a proper key for the lock 57 and releasing the locking pin 53, the entire assembly can be tilted forwardly and away from the adjacent wall due to the rotational action of the knuckles 21 and 31 and without separating the assembly from the support plate 20. Of course, if such complete separation is required, the two knuckles 21 and 31 are easily separated and the dispenser assembly can be lifted from the plate 20. After removal of the pin 53, the entire guard 43 can be removed and the coin box 35 can be bodily removed through the rear of the body portion 28 while in a generally upright position so that the coins can be dumped into a collection receptacle.

The invention as described for a single column dispenser utilizing quarters increases the capacity of the coin box from 160 quarters to 648 quarters without disturbing the traditional mode of assembly and use and while utilizing the standard support plate 20 without any modification. This increase in coin capacity of the cash box allows dispensing of the full stock of product which the hopper portion of the dispenser may hold when full, even where the product units are sold for four quarters each.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A dispenser for product units comprising an elongated vertical wall-attached support plate having a hinge knuckle at its lower end for the rotational support of a dispenser assembly, an elongated dispenser body portion including at least one product storage hopper and a coin mechanism for the release of product units one at a time from the hopper, and said body portion including an inclined bottom wall extending downwardly and forwardly from the lower end of said support plate at an acute angle to the support plate, a hinge knuckle on the body portion at the top of the inclined bottom wall and being supportively and rotationally engaged with the hinge knuckle of the support plate, the body portion including a product outlet at its front and at the bottom of said inclined bottom wall, means within the lower part of the body portion forming a downwardly tapering coin box support pocket above said inclined bottom wall and above said product outlet, a vertically elongated coin box including a downwardly tapering lower end portion having an inclined bottom wall parallel to the bottom wall of the body portion and being removably engageable in said pocket, the coin box being disposed under the coin mechanism while resting in said pocket, the back of said body portion being open to permit removal of the coin box therefrom, means to releasably lock the top of said body portion to the top of the support plate with the body portion in an upright position and with said hinge knuckles supportively engaged, and a guard for the lower end portion of the dispenser comprising a three-sided structure adapted to extend around the front and side walls of the body portion and having a partial bottom wall which is inclined and parallel to the bottom wall of the body portion and adapted to engage under the bottom wall of the body portion, and the guard having a product outlet in registry with the outlet of the body portion, and means to releasably lock the guard on the dispenser.

2. A dispenser for product units as defined in claim 1, and the last-named means comprising a U-strap adapted to extend around the back and opposite sides of the dispenser, and a lockable and removable cross pin extending between the opposite sides of the U-strap and across the front of the guard and the front of the body portion.

3. A dispenser for product units as defined in claim 2, and the guard including a vertical inverted U-shaped loop extending around the top and opposite sides of the coin mechanism and extending above said U-strap and said cross pin, the top of the coin mechanism projecting forwardly of the front of said body portion.

4. A dispenser for product units as defined in claim 1, and said means forming said downwardly tapering coin box support pocket comprising an inclined panel carried by the front wall of the body portion immediately above the product outlet of the body portion and above and parallel to the inclined bottom wall of the body portion, and the rear end of said panel terminating in the body portion forwardly of the back of the body portion and forwardly of said support plate to define an unobstructed gravity passageway for product units between the back of the coin box and said support plate and between said inclined panel and inclined bottom wall of the body portion.

* * * * *